US007022953B2

(12) United States Patent
Nguyen et al.

(10) Patent No.: US 7,022,953 B2
(45) Date of Patent: Apr. 4, 2006

(54) ELECTROMAGNETIC FLOWING FLUID HEATER

(75) Inventors: Khanh Kim Nguyen, Spring, TX (US); Thanh Van Pham, Houston, TX (US)

(73) Assignee: Fyne Industries, L.L.C., Spring, TX (US)

( * ) Notice: Subject to any disclaimer, the term of this patent is extended or adjusted under 35 U.S.C. 154(b) by 0 days.

(21) Appl. No.: 10/881,254

(22) Filed: Jun. 30, 2004

(65) Prior Publication Data

US 2005/0269317 A1 Dec. 8, 2005

Related U.S. Application Data

(63) Continuation of application No. 10/860,379, filed on Jun. 3, 2004.

(51) Int. Cl.
*H05B 6/80* (2006.01)

(52) U.S. Cl. ..... 219/687; 219/688; 219/759; 219/756

(58) Field of Classification Search ..... 219/687–689, 219/704, 705, 710, 759, 756
See application file for complete search history.

(56) References Cited

U.S. PATENT DOCUMENTS

| | | | | | |
|---|---|---|---|---|---|
| 4,114,011 | A | * | 9/1978 | Stubbs | 219/688 |
| 4,165,455 | A | * | 8/1979 | Mayfield | 219/688 |
| 4,236,056 | A | * | 11/1980 | Allen et al. | 219/688 |
| 4,310,738 | A | * | 1/1982 | Moretti et al. | 219/688 |
| 4,310,739 | A | * | 1/1982 | Hatem | 219/688 |
| 4,358,652 | A | * | 11/1982 | Kaarup | 219/688 |

FOREIGN PATENT DOCUMENTS

| | | | | |
|---|---|---|---|---|
| WO | WO 93/00781 | * | 1/1993 | 219/688 |

* cited by examiner

*Primary Examiner*—Philip H. Leung
(74) *Attorney, Agent, or Firm*—Patrick Stellitano

(57) ABSTRACT

An apparatus and method for efficient heating fluid by using electromagnetic energy, the fluid is passed into a channeling structure within a region of space illuminated with electromagnetic energy uniformly, equally and simultaneously for rapid heating. Electromagnetic energy penetrates the fluid and causes it to heat. Structure in close proximity to the fluid in the channeling structure efficiently converts electromagnetic energy to heat to further heat the fluid to obtain a substantially homogeneous final desired temperature. The fluid is moved through the channeling structure creating turbulent to maximize the transfer of electromagnetic energy to the fluid.

20 Claims, 5 Drawing Sheets

ELECTROMAGNETIC FLOWING FLUID HEATER

PRIORITY CLAIM

This application claims priority of U.S. patent application Ser. No. 10/860,379 filed 3 Jun. 2004.

TECHNICAL FIELD OF THE INVENTION

The present invention relates to fluid heating systems, particularly to tankless fluid heating systems, and more particularly to tankless microwave-heated water systems.

BACKGROUND OF THE INVENTION

In the field of fluid heating systems for domestic, commercial and industrial use of heated fluid, there are fluid-tank heaters and tankless fluid heaters. For example, water-tank heating systems, such as those found in many homes throughout the world, provide hot water by heating a large volume of water in a water tank. This is wasteful since such a large volume of hot water is needed only intermittently. Tankless water heaters seek efficiency by heating water on demand. Typically, in a tankless system, heat is concentrated about a section of conduit through which the water flows from the water source to the water use point. The section of conduit may be coiled to allow more water to be heated at a time as the water passes through the region of space heated by the heat source. The heat source may be electrical, flame, or microwave.

There are many types of tankless water heater systems and microwave water heaters described in the art. For example U.S. Pat. No. 5,387,780 discloses a "microwave powered boiler" for heating water. A first cabinet is provided that surrounds and protects a second cabinet made of a material such as steel that reflects microwave energy. In the interior space between the first and second cabinet is a thermal insulating material. Enclosed within the second cabinet is a third cabinet that forms a tank where the water is heated. A microwave source coupled to wave guiding structure feeds microwave energy to the region between the second and third cabinet. The wall of the third cabinet allows microwave energy to penetrate there through to heat the water enclosed thereby. A thermostat control system is provided so that when the water temperature in the tank is lower than the set point, the magnetron microwave source is initiated to generate microwave energy to heat the water until the set point is reached.

An example of a tankless water heater system that uses a microwave source and a coiled conduit section is provided by Electro Silica, a provider of water heating systems. Their website on the World Wide Web is electrosilica.com. There is shown a system wherein cold water received from a water source flows generally downward through a coiled conduit section that is enclosed within a stainless steel tank. The coil is disposed against the interior wall of the tank. Above the coil and above or at the top of the region enclosed by the tank, is a set of magnetrons that produce microwave energy at 2450 Mega-Hertz (MHz). The coil is flexible and made of a silica-based substance that enables microwaves to penetrate there through and heat the water therein. The metal tank shaped, purportedly to prevent "generation of refraction and diffraction waves." The base of the chamber formed by the tank serves as a reflecting dish to direct energy upward towards the silica based flexible coil in the chamber. As demand for water is made, the magnetron sources initiate to produce microwave energy that propagates in the chamber. Some of this energy propagates into the water in the coiled conduit and is absorbed by the water to generate heat. At the bottom of the steel chamber is an outlet to supply water that has been heated within the chamber.

One problem presented by tankless and microwave heaters is the relative inefficiency of energy transfer. Ideally, one would want all of the generated energy to be converted to heat only the fluid as it passes through a well-defined region. In practice, some energy generated by the source will not heat the fluid, but rather, will be dissipated and conducted away by structure exterior to the fluid. In the case of microwave-heated systems, some microwave energy never enters the water, but is reflected away by the boundary of the water-carrying conduit section. This further reduces efficiency.

For at least these reasons, there is a need for a more efficient electromagnetic-energy-heated tankless water heater.

SUMMARY OF THE INVENTION

The present invention provides a method for efficient heating of fluid by electromagnetic energy. According to an aspect of the present invention, an electromagnetic energy source is coupled to an enclosure to produce electromagnetic energy within the enclosure. Within the enclosure, structure channels fluid through the enclosure and substantially converts electromagnetic energy to heat in the proximity of the fluid within the enclosure to add substantial heat to the fluid.

According to another aspect of the invention, a membrane is provided that enables substantial penetration of electromagnetic energy through the membrane. A fluid channeling structure is provided that channels fluid through the enclosure from an inlet to an outlet. Electromagnetic energy from a source penetrates the membrane and heats the fluid in the channeling structure. Either the channeling structure or structure in close proximity thereto is comprised of a material that generates heat in response to electromagnetic energy. Thus, structure is provided to channel the fluid through the enclosure and that substantially converts electromagnetic energy to heat in proximity to the fluid.

The foregoing has outlined rather broadly aspects, features and technical advantages of the present invention in order that the detailed description of the invention that follows may be better understood. Additional aspects, features and advantages of the invention will be described hereinafter. It should be appreciated by those skilled in the art that the disclosure provided herein may be readily utilized as a basis for modifying or designing other structures for carrying out the same purposes of the present invention. Persons of skill in the art will realize that such equivalent constructions do not depart from the spirit and scope of the invention as set forth in the appended claims, and that not all objects attainable by the present invention need be attained in each and every embodiment that falls within the scope of the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
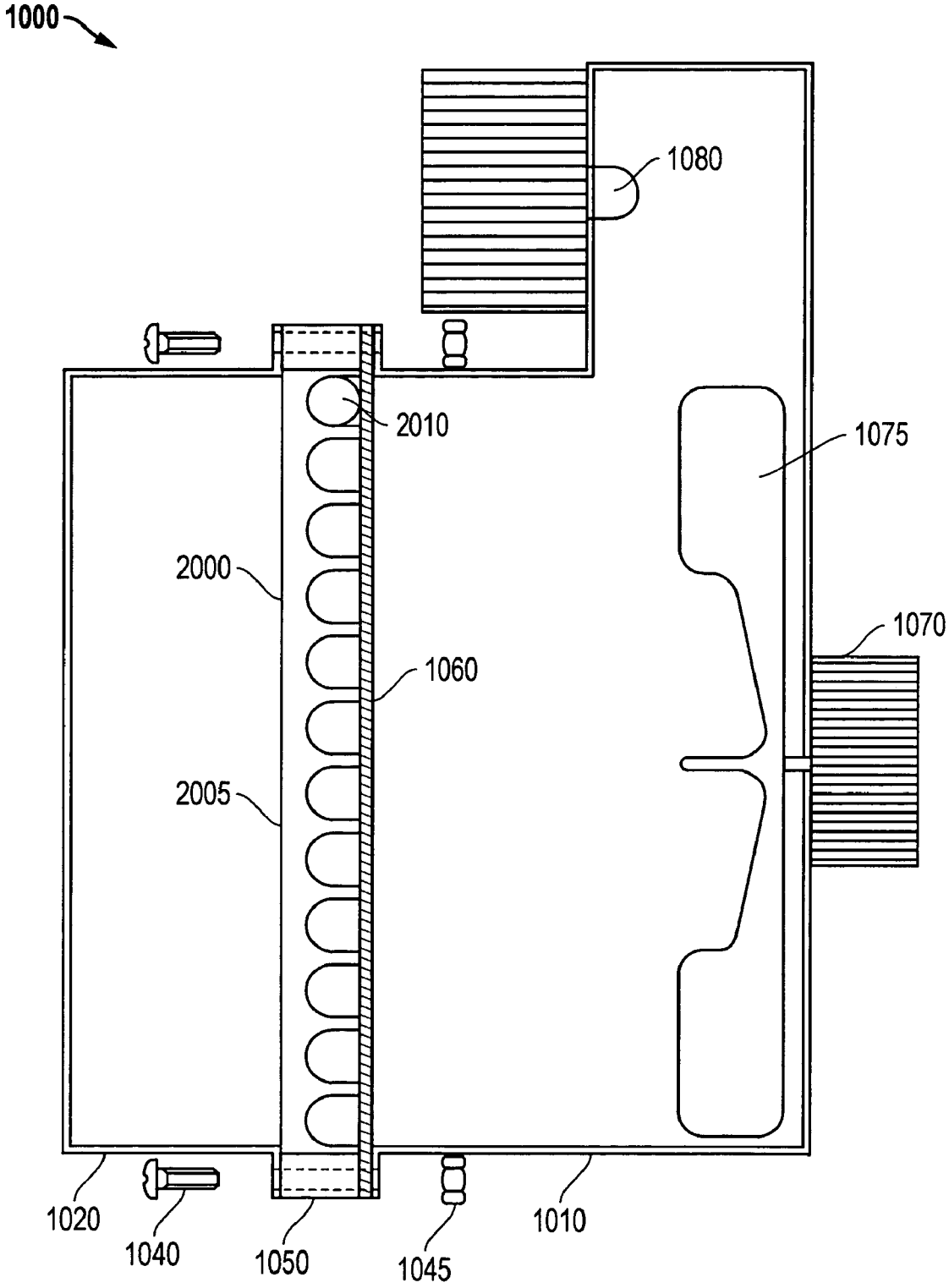
FIG. 1 is a side view of a preferred embodiment of the present invention.

FIG. 1 illustrates a side view of a preferred embodiment of the present invention. An enclosure 1000 comprising a first section 1010 and a second 1020 is provided. The first and second sections, 1010 and 1020, are brought together so that a fluid flow channeling structure 1050 is captured within the cavity formed by joining the first and second sections. An electromagnetic energy source 1080, such as a magnetron or a klystron, is positioned and coupled to the cavity. The walls of sections 1010 and 1020 are preferably metallic to confine the electromagnetic energy there within.

As shown in FIG. 1, fluid flow channeling structure 1050 has a flange with bolt holes so that bolts 1040 can be inserted there through. First section 1010 also exhibits a flange with holes that align with the holes in the flange of channeling structure 1050. Placed between first section 1010 and channeling structure 1050 is a membrane 1060. Membrane 1060 has holes around its outer periphery that align with the holes of the flanges of first section 1010 and channeling structure 1050. Second section 1020 also has a flange with holes aligned with the holes in channeling structure 1050. Bolts 1040 thereby pass through the flange of second section 1020, through channeling structure 1050, through membrane 1060, and through the flange of first section 1010, wherein the bolts 1040 are secured by nuts 1045.

At a side of first section 1010 provision is made for a circulation fan motor 1070 and fan blade 1075 to distribute electromagnetic energy evenly in the enclosure 1000. If the fan blade 1075 is made of a low-loss, low-dielectric constant material, it will cause less perturbation of the electromagnetic fields in the cavity than a fan blade that is metallic. A metal fan blade will reflect electromagnetic energy waves and substantially affect the field distribution in the cavity.

Figure 2:
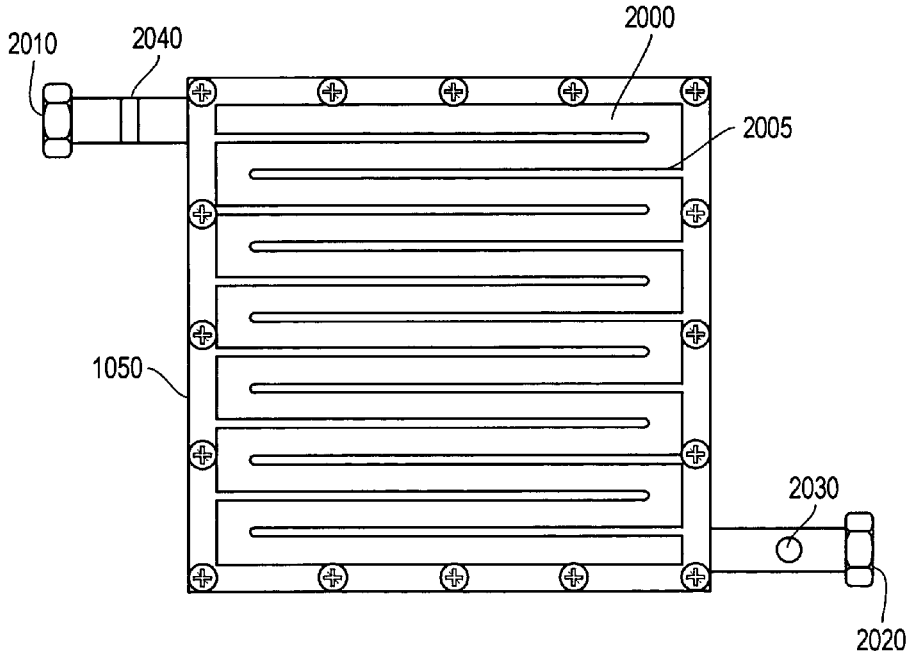
FIG. 2 is a top view of a fluid channeling structure.

A top view of fluid flow channeling structure 1050 is shown in FIG. 2. A fluid inlet 2010 is connected to a cold fluid source using standard fittings. A flow sensor or switch 2040 is provided to measure whether a threshold level of fluid is passing through inlet 2010 to determine the level of instantaneous demand. Fluid inlet 2010 directs fluid into a series of parallel channels 2000 formed by partitions 2005. An outer perimeter of structure 1050 can be treated with a electromagnetic energy reflecting material to prevent leakage of electromagnetic energy from the enclosure. The channels are connected sequentially so that fluid flows first in one direction then in another direction in a raster pattern to substantially increase the volume of fluid being heated in the enclosure at any instant of time. The channel structure of the illustrated embodiment is exemplary. Other patterns for channeling the fluid may be implemented. For a household water heating application, the channeling structure may be of outside dimensions of 10 inches by 10 inches, and 1 inch thick with the source operating at 2.45 Giga-Hertz (GHz) with a free space wavelength of about 4.82 inches.

Note that unlike a coil, channels 2000 create turbulent, as opposed to laminar, fluid flow to maximize the transfer of electromagnetic energy to the molecules of the fluid. A hot fluid outlet 2020 is provided at an end of the channeling structure to communicate heated fluid to one or more use points. A temperature probe 2030 is provided at outlet 2020 to measure the temperature of the fluid that exits channeling structure 1050.

Figure 3:
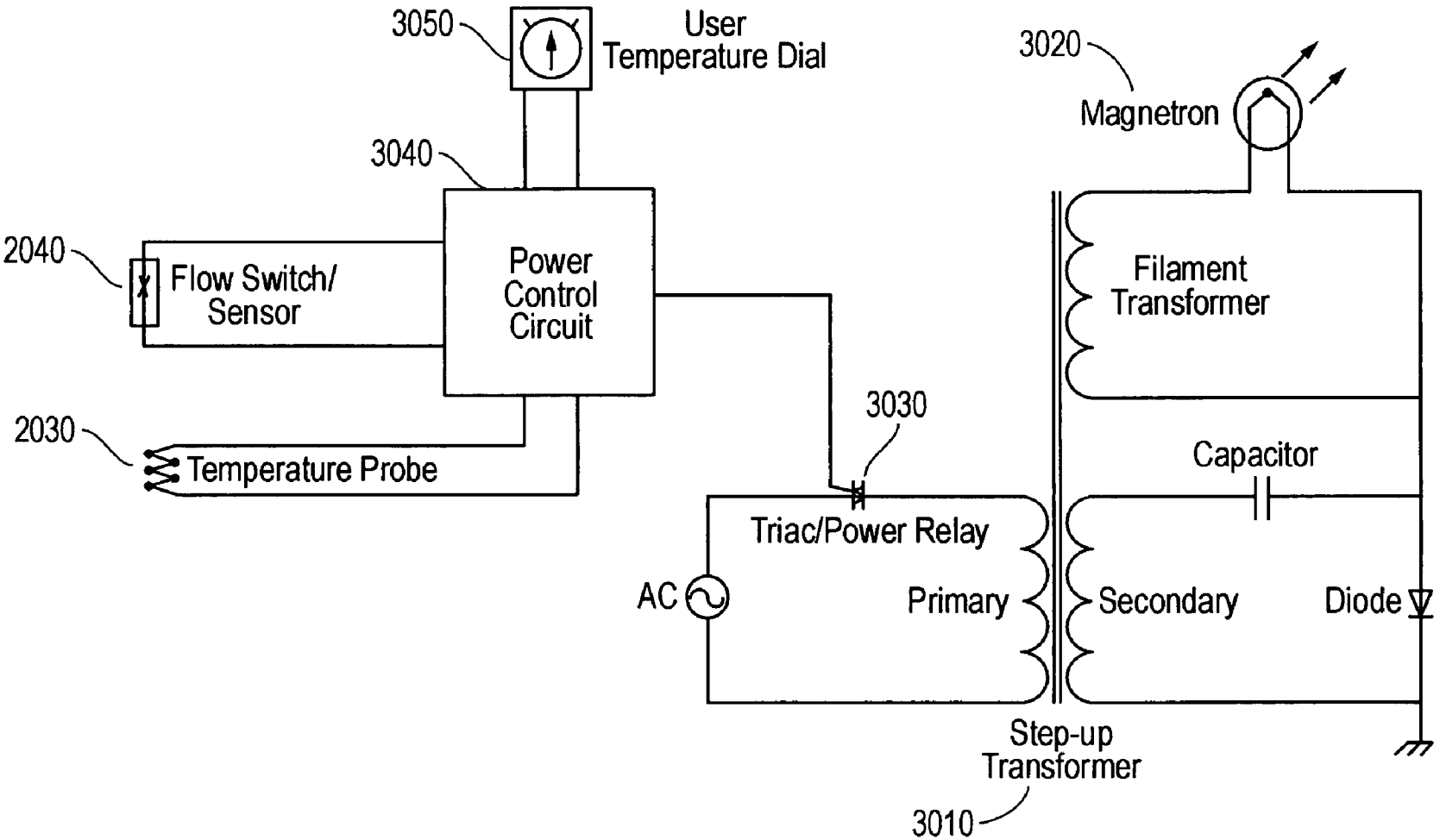
FIG. 3 is a circuit for control of a magnetron.

Electronics for controlling a magnetron in response to signals from a temperature-setting device 3050, temperature probe 2030, and flow switch or sensor 2040 are shown in FIG. 3. A step up transformer 3010 provides power to the magnetron 3020 when the Triac or Power Relay device 3030 is activated by power control circuit 3040. Power control circuit 3040 receives signals from probe 2030 and flow switch or sensor 2040. According to one implementation, if flow switch or sensor 2040 detects that fluid is flowing within the preset flow rate, then no demand for hot fluid exists, and the fluid is not heated. If fluid exceeding the preset flow rate of the flow switch or sensor 2040 does flow, then the fluid is heated to maintain a constant temperature at the outlet as measured by temperature probe 2030. A constant temperature is user-selected by way of the temperature-setting device 3050.

Returning to FIG. 1, electromagnetic energy source 1080 generates electromagnetic energy in a frequency band for which the fluid strongly absorbs electromagnetic energy. For example, several frequency bands for which water is an especially strong microwave absorber are known. The electromagnetic energy generated by electromagnetic energy source 1080 enters the cavity of enclosure 1000 containing channeling structure 1050. This energy propagates and impinges upon membrane 1060. Membrane 1060 is ideally a rigid low-loss dielectric material that allows electromagnetic energy impinging upon it to pass through it into the water. Channeling structure 1050 is made of a high loss material that absorbs electromagnetic energy at the source frequency rather efficiently and generates substantial heat in response. A high electromagnetic energy susceptor material with these properties is silicon carbide.

Thus, electromagnetic energy penetrates membrane 1060, enters the fluid, and is partially absorbed by the fluid to generate heat. Energy not absorbed by the fluid enters the electromagnetic-energy-absorbing fluid channeling structure and is at least partially absorbed thereby to generate heat. This heat from the channeling structure is absorbed by the fluid, thereby raising the temperature of the fluid further. Note that electromagnetic energy entering the electromagnetic-energy-absorbing channeling structure is rapidly attenuated so that a substantial portion of the energy entering the structure is absorbed therein. Any energy penetrating through the channeling structure will reflect from an interior surface of enclosure 1000 back to the channeling structure to be absorbed thereby.

Unlike the prior art, where the fluid channeling structure is intentionally made of a low-loss material that enables substantial penetration without substantial absorption, of electromagnetic energy, the present invention provides: (1) structure that enables penetration of electromagnetic energy into the fluid and (2) structure in proximity to the flowing fluid that substantially converts electromagnetic energy to heat. Note that the structure that enables penetration of electromagnetic energy into the fluid may itself be a electromagnetic energy absorbing structure. Thus, for example, membrane 1060 may be comprised of a thin layer of silicon carbide. The membrane then allows some electromagnetic energy to penetrate into the water, while converting some electromagnetic energy to heat that is conducted to the water.

The enclosure containing an electromagnetic-energy-absorbing structure as described herein can be viewed as a loaded electromagnetic cavity, with the fluid-filled channeling structure as the load. Clearly, an ideal rectangular cavity can sustain an electric field distribution that is zero at the top and bottom and maximum in the middle. Thus, one may position the channeling structure about halfway between the top and bottom of the enclosure. Alternatively, since the ideal rectangular cavity can sustain a field that is zero at the bottom and is maximum one-quarter wavelength from the bottom, one may position the channeling structure about one-quarter wavelength from the bottom. The position of the channeling structure within the enclosure that produces maximum transfer of electromagnetic energy to fluid heat can be determined by experimentation.

Figure 4:
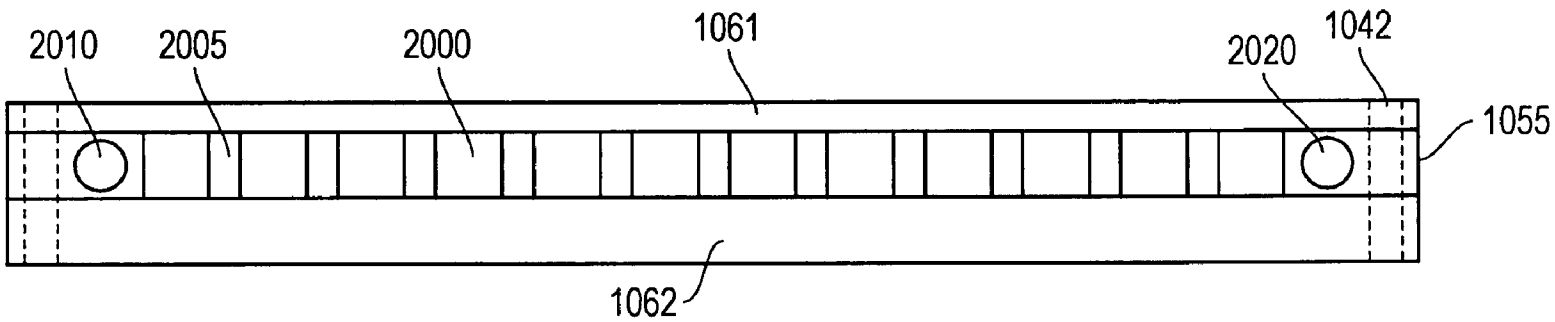
FIG. 4 is a side view of an alternative embodiment of a fluid channeling structure.

Shown in FIG. 4 is an alternative embodiment of fluid flow channeling structure 1050. A grill-like channeling structure 1055 has on top an upper sheet of material 1061 and on bottom a lower sheet of material 1062. The parts are assembled by passing bolts through bolt holes 1042 positioned around the periphery of the assembly. Grill-like channeling structure 1055 comprises partitions 2005 forming channels 2000 for fluid to flow from inlet 2010 to outlet 2020. By forming the structure from separate pieces assembled together, each piece can be made of a material chosen for its response to electromagnetic energy.

For example, upper sheet 1061 can be chosen to be a low-loss membrane that allows substantial penetration of electromagnetic energy there through without substantial electromagnetic energy absorption. Alternatively, for example, upper sheet 1061 can be chosen to allow substantial electromagnetic energy penetration, yet with some absorption within the upper sheet. This would create an upper hot plate to heat the fluid while still allowing substantial electromagnetic energy to penetrate into the fluid. Lower sheet 1062 will be chosen as a high loss material efficient at converting electromagnetic energy into heat. Such a material, as mentioned, is silicon carbide, which can be manufactured in a wide variety of shapes and absorption capacities, as is well known in the art. Finally, structure 1055 is also preferably made of a high efficiency converter such as silicon carbide that generates substantial heat in response to electromagnetic excitation. Note that the configuration can be sealed to prevent fluid leakage by means known in the art such as epoxy embedding.

Although, a major application for the present invention is the heating of water for household, commercial and industrial applications, the invention may be employed to heat fluid other than water for a variety of applications. The size, and indeed the shape, of the enclosure and channeling structure, may be adapted to the application. Silicon carbide, as noted, can be formed in a variety of shapes. For microheating applications, small channels can be etched into a flat sheet of silicon carbide using methods known in the semiconductor industry. Thus the channeling structure and microwave enclosure can be made of any practical size from very small to very large.

The size of the enclosure will be dependent in part on the volume of fluid that must be heating within the enclosure at an instant of time for a given flow rate and fluid temperature to be achieved. Also, the field distribution in the enclosure is substantially affected by its dimensions. For example, in a particular application the cavity of the enclosure may be dimensioned to be resonant at a given frequency. Then with the cavity loaded by the fluid and channeling structure the electromagnetic energy source may be operated at, above, or below the resonant frequency of the cavity in a frequency range that coincides with a frequency range for which the fluid and structure in proximity to the fluid strongly absorbs microwave energy.

In the alternative to enclosing the channeling structure within a metallic cavity, the channeling structure could be positioned in a region of space that is illuminated with an electromagnetic energy source such as a directional antenna. Although such a configuration is contemplated, a lack of confinement of the electromagnetic energy would be inappropriate for many applications.

Figure 5:
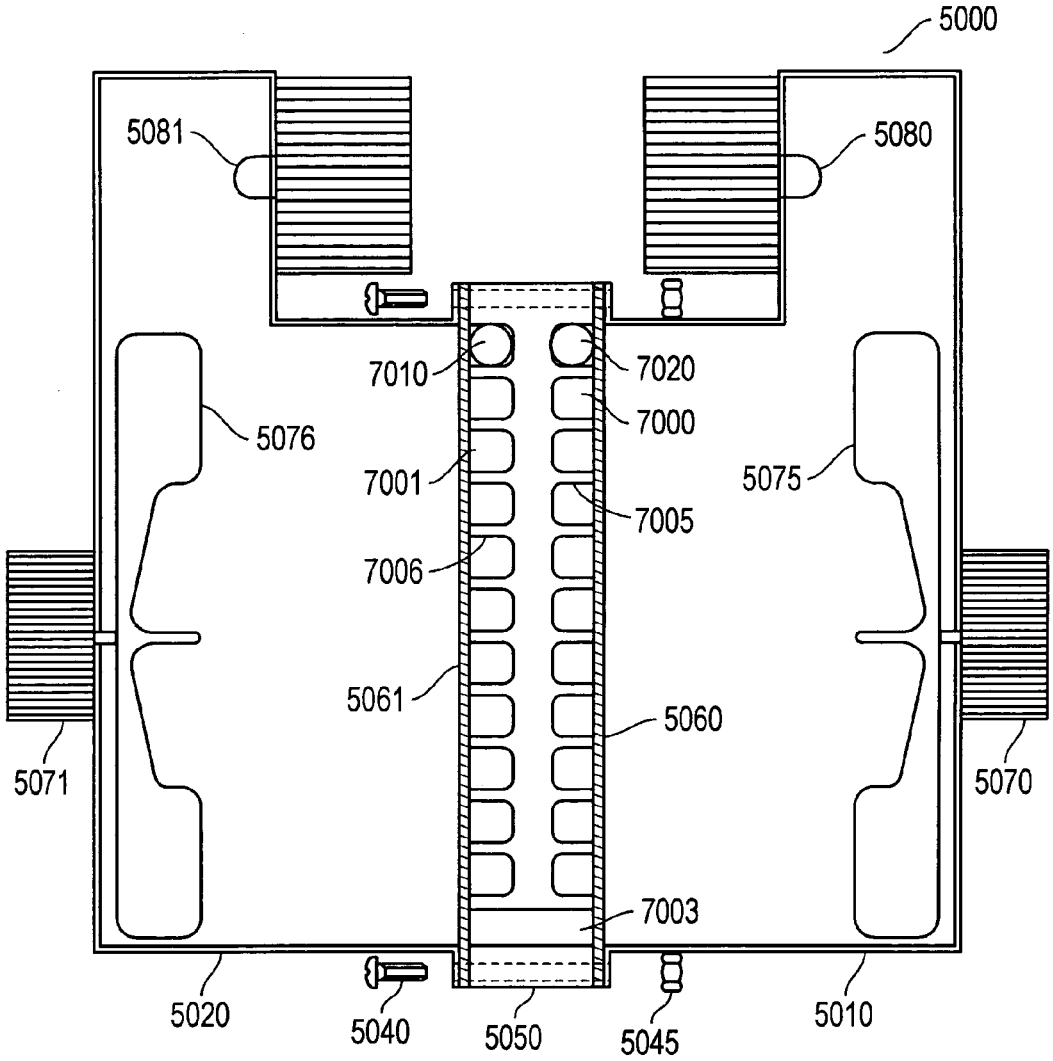
FIG. 5 is a side cross-sectional view of a dual chamber configuration.

FIG. 5 shows a side view of an alternative embodiment of the present invention. A dual-feed chamber 5000 is provided with two electromagnetic energy sources 5080 and 5081. Chamber 5000 comprises a first section 5010 and a second section 5020 that is the mirror image, cross-sectionally, of first section 5010. Similar to the configuration of FIG. 1, within section 5010 is a circulation fan 5075 driven by motor 5070. Section 5020 also has a circulation fan 5076 driven by motor 5071.

Enclosed between sections 5010 and 5020 is a fluid channeling and heating structure 5050. The assembly of sections 5010, 5020 and 5050 is accomplished with bolts 5040 secured by nuts 5045 around the periphery of structure 5050. Structure 5050 comprises two membranes 5060 and 5061, one on each side of structure 5050. These membranes allow substantial penetration of electromagnetic energy there through. The membranes may be made of a low loss dielectric or a thin layer of high loss material such as silicon carbide.

Structure 5050 is comprised of a first set of channels 7000 formed by a first set of partitions 7005 and a second set of channels 7001 formed by a second set of partitions 7006. Fluid enters channels 7001 through fluid inlet 7010. Fluid exits channels 7000 through fluid outlet 7020. Fluid in channels 7001 is communicated to fluid in channels 7000 by a partial open section at the very end of common channel region 7003. When both sources 5080 and 5081 are operating, the fluid flowing through channels 7000 is heated predominately by the energy generated by source 5080, and the fluid flowing through channels 7001 is heated predominately by the energy generated by source 5081.

The configuration of FIG. 5 presents several advantages. If one of the sources, 5080 or 5081, fails, the other source can still function to generate energy to heat the fluid to a desired degree. Indeed, the system can be operated with one source at a time. Also, the dual-level channeling structure 5050 allows about twice the volume of fluid to be in the region of heat generation as the embodiment of FIG. 1.

Although the present invention and its advantages have been described in detail, it should be understood that various changes, substitutions and alterations can be made herein without departing from the spirit and scope of the invention as defined by the appended claims. The invention achieves multiple objectives and because the invention can be used in different applications for different purposes, not every embodiment falling within the scope of the attached claims will achieve every objective. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A electromagnetic fluid heating apparatus, comprising:

a chamber that substantially confines electromagnetic energy of an electromagnetic field there within to form a cavity that exhibits resonances; and positioned within the chamber where a component of the electromagnetic field is large, a fluid flow channeling structure through which fluid flows, the fluid flow channeling structure comprising;

a base member exhibiting a thickness and an outer perimeter extending substantially to peripheral walls of the chamber, the base member comprising a material to substantially convert electromagnetic energy to heat energy to heat fluid flowing through the channeling structure;

channel walls exhibiting a thickness and extending outward from the base member, forming sequential adjacent channels through which fluid flows, each of a plurality of the sequential channels sharing a common wall with an adjacent channel, the channel walls comprising a material that substantially converts electromagnetic energy to heat energy to heat the fluid between the channel walls, and with the channel walls exhibiting a height substantially less than a dimension of the base member so that the fluid can be concentrated where a component of the electromagnetic field is large; and an electromagnetically transmissive cover member exhibiting a thickness and an outer perimeter extending substantially to peripheral walls of the chamber, and positioned to confine the fluid in the chamber between the channel walls and to enable substantial penetration of electromagnetic energy there through to heat the fluid, so that fluid is heated directly by electromagnetic energy penetrating through the transmissive cover into the fluid and indirectly by heat from the channel walls and base member.

2. The apparatus of claim 1, wherein the channel walls are formed in a structure that is removably detachable from the base member.

3. The apparatus of claim 1, wherein the channel walls are formed in a structure inseparable from the base member.

4. The apparatus of claim 1, wherein the fluid flow channeling structure is positioned about a quarter-wavelength from an end wall of the chamber.

5. The apparatus of claim 1, wherein the fluid flowing channeling structure is placed at an end wall of the chamber.

6. A electromagnetic fluid heating apparatus, comprising:

a microwave cavity that exhibits resonances; and positioned within the cavity where a component of the electromagnetic field is large, a fluid channeling structure comprising;

a base member comprising a material to substantially convert electromagnetic energy to heat energy to heat fluid flowing through the channeling structure;

channel walls extending outward from the base member, forming adjacent channels through which fluid flows sequentially, the channel walls comprising a material that substantially converts electromagnetic energy to heat energy to heat the fluid between the channel walls, and with the channel walls exhibiting a height substantially less than a dimension of the base member so that the fluid can be concentrated where a component of the electromagnetic field is large; and an electromagnetically transmissive cover member positioned to confine the fluid in the chamber between the channel walls and to enable substantial penetration of electromagnetic energy there through to heat the fluid, so that fluid is heated directly by electromagnetic energy penetrating through the transmissive cover into the fluid and indirectly by heat from the channel walls and base member.

7. The apparatus of claim 6, wherein the channel walls are formed in a structure that is removably detachable from the base member.

8. The apparatus of claim 6, wherein the base member and cover member encompass substantially an entire cross section of the cavity to increase efficiency.

9. The apparatus of claim 6, wherein the cover member has a capacity to convert electromagnetic energy into heat energy.

10. The apparatus of claim 6, wherein each of a plurality of the sequential channels share a common wall with an adjacent channel.

11. The apparatus of claim 6, wherein the fluid flow channeling structure is positioned about a quarter-wavelength from an end wall of the chamber.

12. The apparatus of claim 6, wherein the fluid flowing channeling structure is placed at an end wall of the chamber.

13. A method for heating fluid with electromagnetic energy, comprising:

forming a microwave cavity that exhibits a resonance;

producing within the cavity, an electromagnetic field that exhibits a maxima at a position within the cavity;

providing a fluid channeling structure with shallow sequential channels formed by channel walls to channel the fluid through the cavity, the channel walls comprising microwave absorbing material and the channels extending to substantially an entire dimension of the cavity, with a depth of a channel that is substantially less than a dimension of the cavity;

providing a base member on one side of the channels to confine the fluid on one side between the channel walls;

providing an electromagnetically transmissive cover member on an opposite side of the channels to cover the channels and confine fluid there within; and positioning the fluid channeling structure within the cavity where the electromagnetic field exhibits a maxima.

14. The method of claim 13, wherein the fluid flow channeling structure is positioned about a quarter-wavelength from an end wall of the chamber.

15. The method of claim 13, wherein the fluid flowing channeling structure is placed at an end wall of the chamber.

16. The method of claim 13, wherein the cover member has a capacity to convert electromagnetic energy into heat energy.

17. The method of claim 13, wherein each of a plurality of the sequential channels share a common wall with an adjacent channel.

18. The method of claim 13, wherein the channel walls are formed in a structure that is removably detachable from the base member.

19. The method of claim 13, wherein the base member comprises a material that substantially converts electromagnetic energy to heat energy.

20. The method of claim 13, wherein the cavity is rectangular.

* * * * *